US009812824B1

(12) United States Patent
Polinski

(10) Patent No.: US 9,812,824 B1
(45) Date of Patent: Nov. 7, 2017

(54) MULTI-CONTACT CONNECTOR FOR AN AUDIO JACK ASSEMBLY

(71) Applicant: David Polinski, Stuart, FL (US)

(72) Inventor: David Polinski, Stuart, FL (US)

( * ) Notice: Subject to any disclaimer, the term of this patent is extended or adjusted under 35 U.S.C. 154(b) by 0 days.

(21) Appl. No.: 15/263,937

(22) Filed: Sep. 13, 2016

(51) Int. Cl.
*H01R 24/58* (2011.01)
*H01R 13/40* (2006.01)
*H01R 13/74* (2006.01)
*H01R 105/00* (2006.01)

(52) U.S. Cl.
CPC ..... *H01R 24/58* (2013.01); *H01R 13/40* (2013.01); *H01R 13/746* (2013.01); *H01R 2105/00* (2013.01)

(58) Field of Classification Search
CPC ..... H01R 2105/00; H01R 2107/00; H01R 13/111; H01R 24/58; H01R 24/60; H01R 13/40; H01R 13/746
USPC ..... 439/668, 669, 265, 856, 857, 656, 723, 439/381
See application file for complete search history.

(56) References Cited

U.S. PATENT DOCUMENTS 4,275,946 A * 6/1981 Manina ..... H01R 24/58 200/51.09
6,220,899 B1 * 4/2001 Suzuki ..... H01R 24/58 439/669
6,270,380 B1 * 8/2001 Shichida ..... H01R 13/7031 200/51.1
6,390,856 B1 * 5/2002 D'Addario ..... H01R 13/17 439/668
6,533,617 B1 * 3/2003 D'Addario ..... H01R 13/17 439/669
6,923,687 B2 * 8/2005 Wang ..... H01R 24/58 439/188
D607,834 S * 1/2010 Huang ..... D13/154
7,654,872 B2 * 2/2010 Lin ..... H01R 24/58 439/668
7,785,119 B1 * 8/2010 Chiang ..... H01R 13/7036 439/188
7,794,285 B1 * 9/2010 Huang ..... H01R 24/58 439/668
7,950,966 B1 * 5/2011 Chen ..... H01R 24/58 439/668
7,967,643 B1 * 6/2011 D'Addario ..... H01R 24/58 439/669
7,988,498 B1 * 8/2011 Lim ..... H01R 24/58 439/668
8,801,476 B2 * 8/2014 Zhang ..... H01R 13/26 439/668
8,888,537 B2 * 11/2014 Do ..... H01R 13/187 439/668

(Continued)

*Primary Examiner* — Chandrika Prasad
(74) *Attorney, Agent, or Firm* — McHale & Slavin, P.A.

(57) ABSTRACT

Disclosed is a stereo audio jack assembly that reduces or eliminates signal loss with an audio plug. The jack assembly employs a support housing having a passageway sized to receive the audio plug with an insulated first connector having first and second terminal strips, each formed integral to a first disk base and positioned to engage the grooved tip of an audio plug when engaged. A second isolated connector includes a terminal strip positioned to engage one side of an audio plug sleeve when engaged. And a third isolated connector includes a terminal strip positioned to engage another side of an audio plug sleeve when engaged to allow for a stereo connection by having distinct contacts.

8 Claims, 7 Drawing Sheets

(56) References Cited

U.S. PATENT DOCUMENTS

| | | | | |
|---|---|---|---|---|
| 9,583,898 | B2 * | 2/2017 | DeCola | H01R 24/58 |
| 9,680,264 | B2 * | 6/2017 | Polinski | H01R 24/58 |
| 2007/0232150 | A1 * | 10/2007 | Lee | H01R 24/58<br>439/668 |
| 2009/0149080 | A1 * | 6/2009 | Wu | H01R 12/57<br>439/668 |
| 2009/0298347 | A1 * | 12/2009 | Wu | H01R 13/7033<br>439/668 |
| 2016/0190753 | A1 * | 6/2016 | DeCola | H01R 24/58<br>439/668 |
| 2017/0093098 | A1 * | 3/2017 | Polinski | H01R 24/58 |

* cited by examiner

MULTI-CONTACT CONNECTOR FOR AN AUDIO JACK ASSEMBLY

RELATED APPLICATION

The instant Application is related to U.S. patent application Ser. No. 14/867,739, filed Sep. 28, 2015, entitled MULTI-CONTACT AUDIO JACK CONNECTOR ASSEMBLY, the contents of which are incorporated herein by reference.

FIELD OF THE INVENTION

This invention relates to the field of connectors used for audio signals; and in particular, to an improved stereo audio jack connector assembly having multiple contacts.

BACKGROUND OF THE INVENTION

Audio jacks, also referred to as phone connectors, phone jacks, or jack plugs, are typically used in connector assemblies for carrying audio signals. Dating back to the late 1800's, the audio jack is one of the oldest electrical standards still in existence. The audio jack is the preferred connector for use in the music industry based upon a 6.35 mm (4 inch) plug diameter, which provides a robust assembly that can be reused indefinitely.

The size of the audio jack makes it easy to grasp without tools, and it cannot be bent if stepped upon or otherwise used in a manner expected of insertion and removal. For this reason, the audio jack is the preferred connector for use with electric guitars, microphones, speakers, amplifiers, line levelers and like equipment found in the music industry, primarily audio signal transmission. The audio jack is cylindrical in shape having two, three or four contacts.

Unique to the audio jack is the amount of surface area that is provided by a cylindrical plug. However, the connector to which the plug engages is typically a single prong having a single point of contact. The single point of contact can become problematic, as it needs to press against the plug in order to create a connection. The greater force the contact imparts upon the plug, the better the electrical connection; however the higher stress placed upon the connector, can cause the ground connector to be off center and lose contact. If the electrical contact is de minimus, the ability to transfer an electrical signal is reduced. The conventional electrical contacts employed to engage the plug provide very little contact surface, which results in poor audio quality.

Numerous attempts have been made to improve upon the audio jack. U.S. Pat. No. 7,874,855 describes an audio jack connector having an insulating housing and a passageway. A contacting terminal is disposed on a side of the passageway having a holding portion and two contacting pieces slanted toward the same side separately from two opposite ends of the holding portion. A first fixing terminal, arranged on a side of the passageway, adjacent to the contacting terminal, has a first fixing slice. The first fixing slice has a side extended obliquely to form a first contacting piece connecting with one contacting piece. A second fixing terminal placed on an opposite side of the passageway has a second fixing slice, a second contacting piece obliquely connected with the second fixing slice for connecting with the other contacting piece. The contacting pieces are forced to slide on and depart from the first contacting piece and the second contacting piece when the contacting terminal is elastically pushed by the inserted plug.

U.S. Publication No. 2007/0232150 describes an audio jack connector including a housing and a set of contacts. The housing has a body, a mating portion extending from one end of the body, and an insertion hole defined in the mating portion and extending inwardly through the body along an axis direction. The set of contacts include signal contacts, a set of switching contacts disposed in the housing, and an exposed contact disposed at the outside of the housing. The switching contacts have a fixed contact and a movable contact. The mating portion of the housing has a cavity defined at an outer surface thereof for receiving a contacting portion of the exposed contact. The contacting portion has a propping block protruding outwardly beyond the outer surface of the mating portion.

U.S. Publication No. 2009/0298347 describes an audio jack connector that is suitable for selectively engaging with either a first multi-pole plug or a second multi-pole plug having more poles than the first multi-pole plug. Each of the multi-pole plugs has a plurality of poles insulated by insulating rings arranged thereinbetween. The audio jack connector includes an insulating housing having a chamber extending inward from a front thereof, and terminal groups. The terminal groups are disposed in the corresponding grooves and project into the chamber. When either of the first and the second multi-pole plugs is respectively inserted into the chamber, the terminal groups are against the multi-pole plug, wherein at least one of the terminal groups is against one of the insulating rings of the first multi-pole plug.

U.S. Pat. No. 6,220,899 discloses a connecting sleeve spring resiliently mounted in a connecting sleeve of an electrical connecting jack. The connecting sleeve spring has a arcuate sinusoid-like side profile, with its two ends curving in a direction opposite the curve of a center contact portion. The center portion has an inwardly angled tongue. When a plug having a collar is inserted into the electrical connecting jack, the collar comes in contact with the tongue and pushes the central contact portion inward, thus forcing the two ends of the connecting sleeve spring to move outward. The two ends press against the inner periphery of the collar.

U.S. Pat. No. 6,270,380 discloses a multipolar electrical connector that, as a counter connector 90, uses a single-head plug having a pole shaft in which center poles are disposed in plural positions in the axial direction, respectively (hereinafter, referred to merely as "multipolar connector"). In the invention, plural predetermined contact pieces are incorporated into the body, so that plural poles are ensured by the predetermined contact pieces. A required number of first additional contact pieces and second additional contact pieces are placed on the outer and inner peripheral sides of the boss portion, so that two or more poles are ensured by the additional contact pieces. According to the invention, therefore, the number of poles is increased by that of poles which are formed by the additional contact pieces.

U.S. Pat. No. 6,923,687 discloses an audio jack connector comprising a rectangular-shaped insulating housing, and a plurality of different contacts. The insulative housing has a base and a mating portion. A channel extends through the base and the mating portion. A front end of the channel defines a gap, and a number of receiving slits defined on the base at two sides of the channel, the base defining a depression communicating with the channel at a top wall thereof. A first and a second contact are received in the slits. A third contact mates with the top wall and comprises a mounting portion extending beyond the bottom wall of the insulative housing. A fourth contact is installed in a front end of the insulative housing and has an engaging portion extending through the gap and inserted into the front end of the channel for electrically connecting the mating plug connector.

U.S. Pat. No. 7,654,872 discloses an audio jack connector which includes a housing and a terminal group. The housing has an insertion hole extending inward from the front of the housing. The bottom of the base defines at least one signal terminal recess and an auxiliary terminal recess, a first aperture is defined in the bottom of the auxiliary terminal recess and communicates with the signal terminal recess. The terminal group has at least one signal terminal and an auxiliary terminal received in the signal terminal recess and the auxiliary terminal recess respectively. The signal terminal has a contact portion projecting into the insertion hole and an elastic portion extending from the end of the contact portion.

U.S. Pat. No. 7,785,119 discloses an audio jack connector having an insulating housing defining a rectangular base. The base has a passageway passing therethrough for receiving an inserted audio plug connector. A channel is formed at a top surface of the base for communicating with the passageway. A set of switch terminals mounted to the insulating housing comprise an elastic terminal and a fixing terminal. The elastic terminal has a first top plate and a switch arm extended outward from the first top plate, with a free end thereof projecting into the passageway through the channel. The fixing terminal has a second top plate disposed above the channel. The second top plate has a pair of cantilever switch slices extending toward each other and perpendicular to an extending direction of the switch arm, with free ends thereof suspended over the free end of the switch arm and spaced from each other.

U.S. Pat. No. 7,794,285 discloses an audio jack connector for receiving an audio plug connector which includes an insulating housing and a contact terminal. The insulating housing defines an insertion hole from a front end to a rear end thereof for receiving the audio plug connector and a recess communicating with the insertion hole. The contact terminal has a connecting portion received in the recess. Two opposite ends of the connecting portion are extended toward a same side to form a base portion and a first elastic arm. A first contact portion is protruded towards the base portion from a free end of the first elastic arm. A second elastic arm is bent towards the connecting portion from one end of the base portion. A second contact portion is protruded towards the first elastic arm from a free end of the second elastic arm. The first and second contact portions protrude into the insertion hole.

U.S. Pat. No. 8,801,476 discloses an electrical contact of an audio jack connector including a main portion, a soldering portion bending from a lateral edge of the main portion, an elastic portion extending curvedly from a distal end of the main portion to be located above the main portion. The elastic portion has a flexible beam, a first arm extending upwardly from the flexible beam and a second arm curvedly bending from the first arm. The first arm is consistent with a direction along which an audio plug connector is inserted. The second arm is adverse to a direction along which the audio plug connector is withdrawn.

U.S. Pat. No. 8,888,537 discloses an improved electronic audio receptacle connector which employs contacts that have multiple points of contact with a mating audio plug. The contacts each have multiple segments, each segment having a plurality of transverse fingers that interface with a conductive portion of the audio plug. The multiple points of contact improve the reliability of the receptacle connector. The housing of the receptacle connector may be made of two portions mated along an interface. The two portions may have features along the interface to impede moisture ingression and to interlock them together. U.S. Pat. No. D607,834 discloses an ornamental design for a contact of an audio plug connector.

SUMMARY OF THE INVENTION

Disclosed is a stereo audio jack assembly for receiving a conventional audio plug comprising a support housing having a passageway sized to receive the audio plug. The support housing has an insulated first connector having first and second terminal strips, each having a proximal end formed integral to a first disk base and extending obliquely and symmetrically to a distal end. The distal end of the terminal strips are positioned to engage the grooved tip of an inserted audio plug. A second isolated connector with first and second terminal strips, each having a proximal end extending obliquely and symmetrically from an outer edge of second disk base to a distal end, are positioned to engage the sleeve of the audio plug. The second connector is positionable on the mounting collar and electrically isolated from the first connector, wherein the second connector is fastened to the support housing securing said first connector therebetween.

An objective of the instant invention is to provide a stereo audio jack assembly that reduces or eliminates signal loss between the jack receptacle and a conventional audio plug.

Another objective of the invention is to provide a stereo audio jack assembly that employs connectors formed integral with a common base to provide a uniform clamp pressure on the sleeve and grooved tip of an audio plug.

Yet still another objective of the invention is to provide a stereo audio jack assembly that employs a metal bias with four terminals spaced 90 degrees apart to provide a consistent pressure gradient upon an engaged audio plug.

Still another objective of the invention is to provide a stereo audio jack assembly having scalloped terminals for engaging a larger surface area of an audio plug to assure a resistance free connection.

Yet still another objective of the invention is to provide a stereo audio jack assembly having terminals that are maintained in position by a notched insulator ring.

Still another objective of the invention is to provide a stereo audio jack assembly that is compact in size and easy to assemble.

Yet still another objective of the invention is to provide a stereo audio jack assembly design that can be scaled from ¼ inch, ⅛ inch, and micro sizes.

Other objectives and further advantages and benefits associated with this invention will be apparent to those skilled in the art from the description, examples and claims which follow.

DETAILED DESCRIPTION OF THE PREFERRED EMBODIMENT

Figure 1:
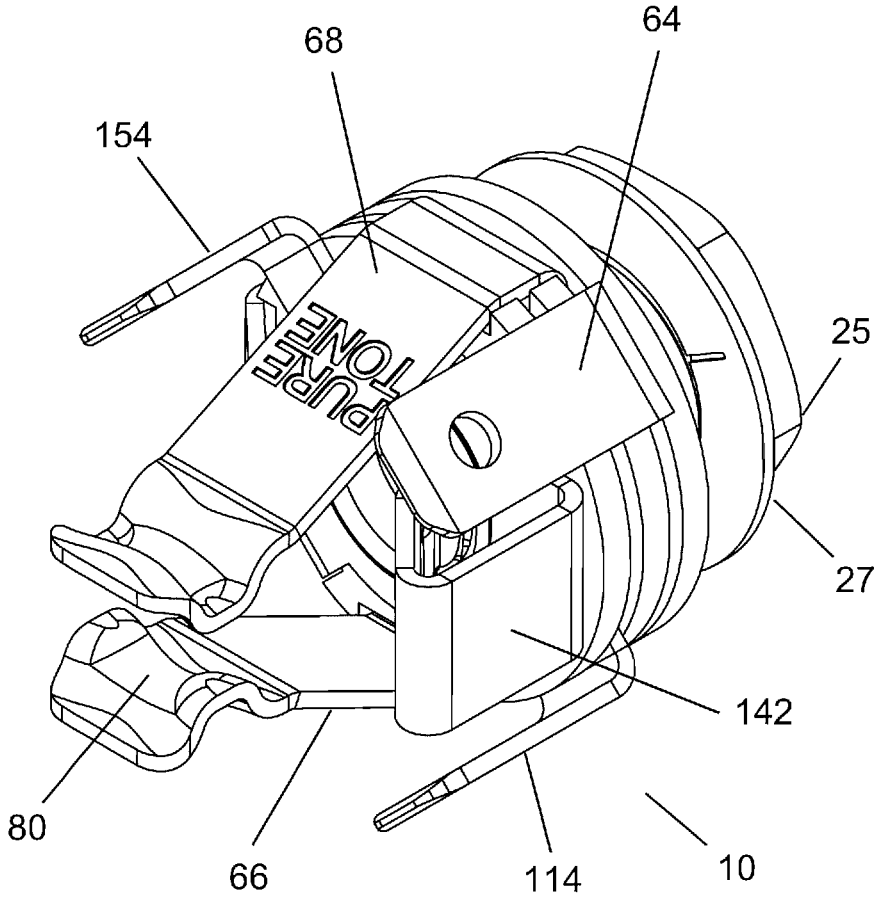
FIG. 1 is a perspective view of the stereo audio jack assembly.
Figure 2:
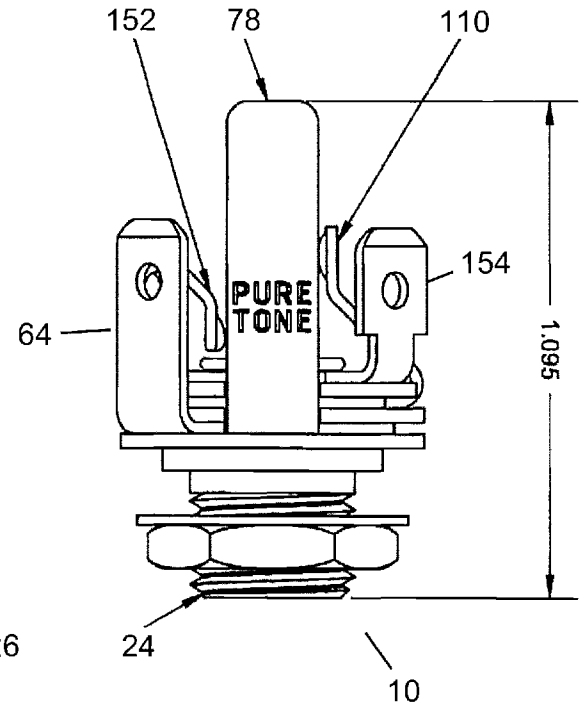
FIG. 2 is a front view thereof.
Figure 3:
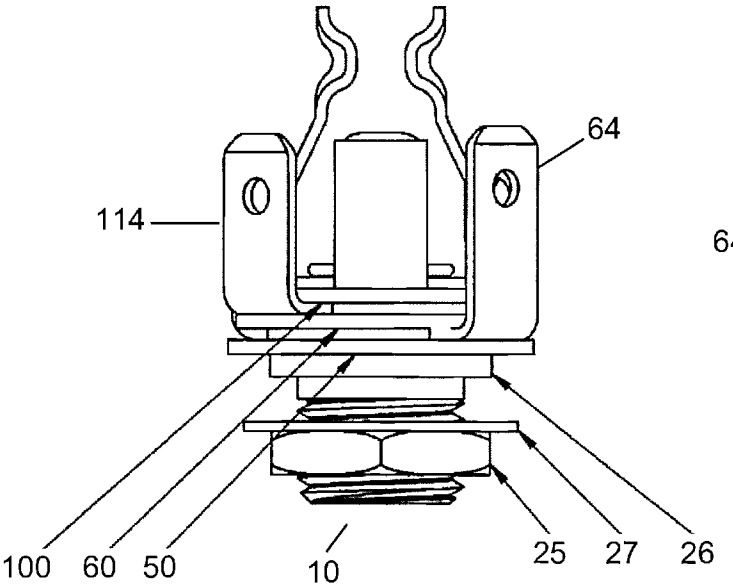
FIG. 3 is a side view thereof.
Figure 4:
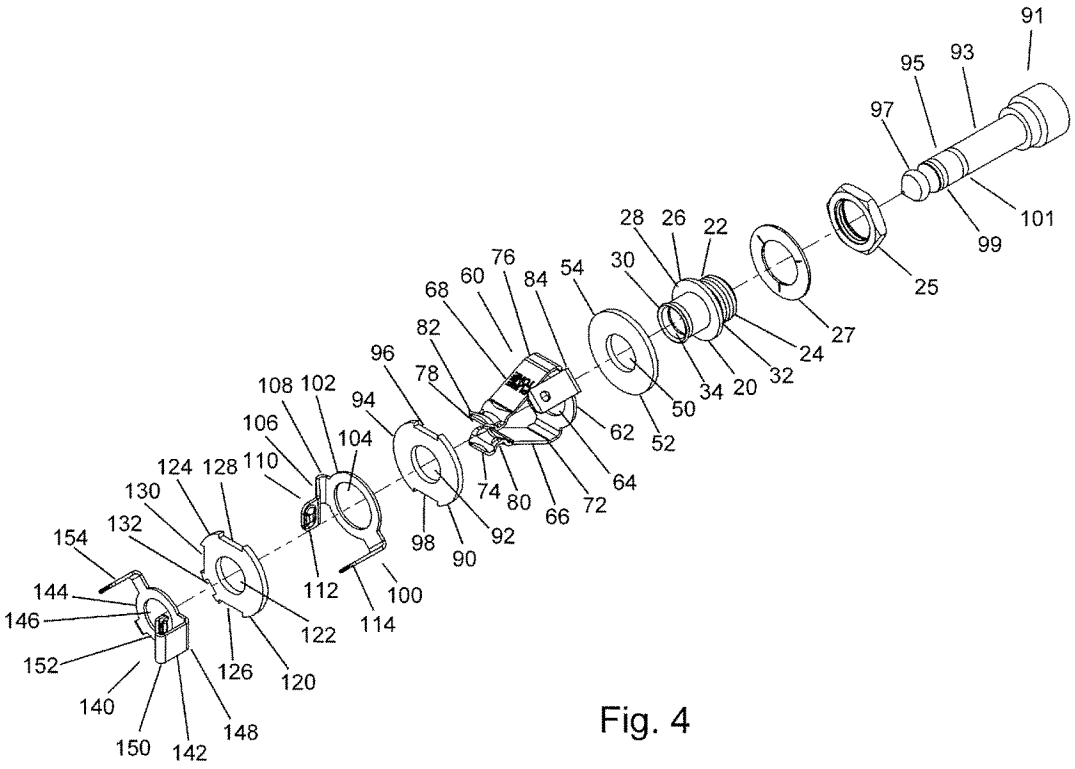
FIG. 4 is an exploded view thereof.
Figure 5:
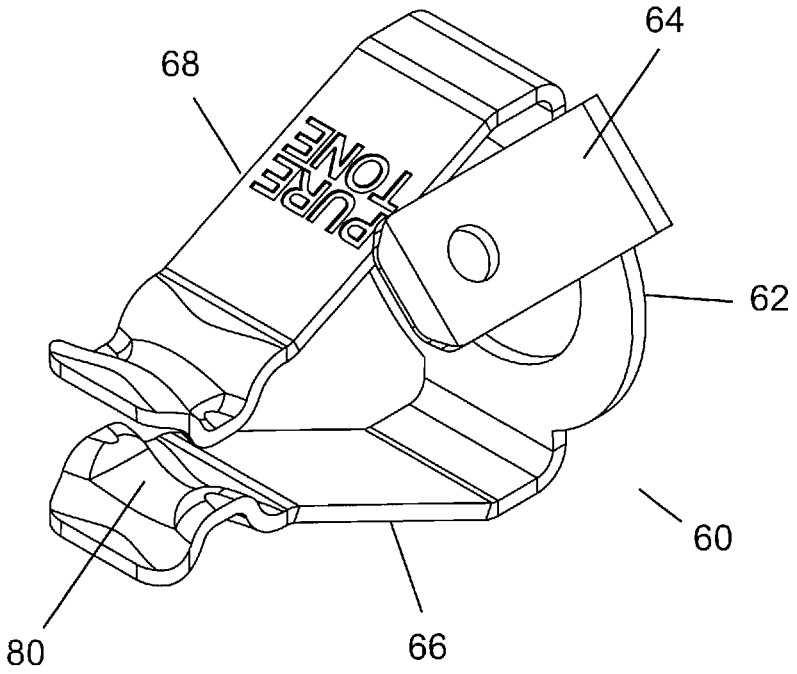
FIG. 5 is a perspective view of the first connector.
Figure 6:
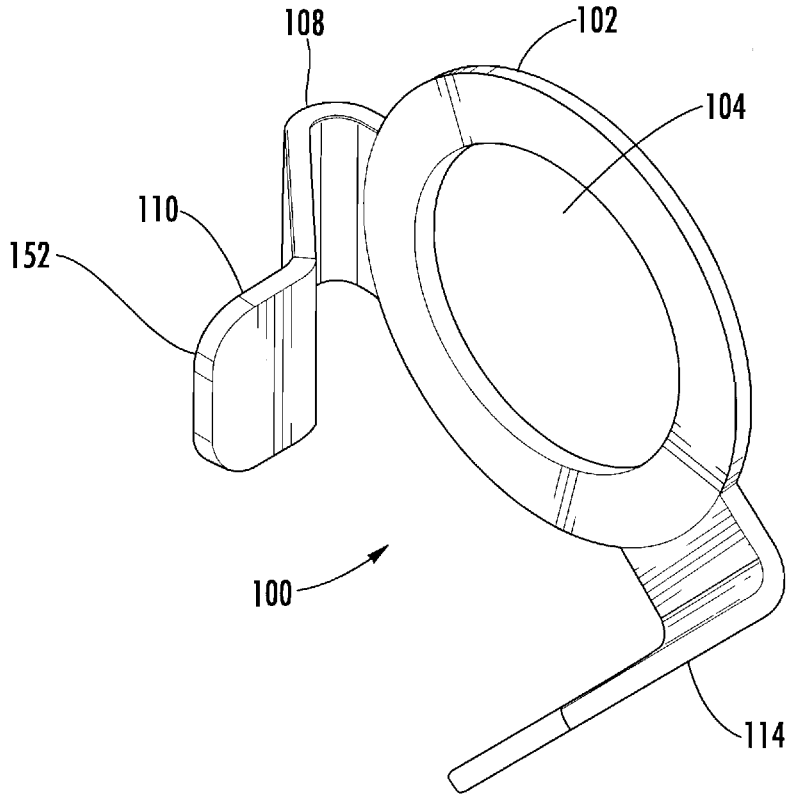
FIG. 6 is a perspective view of the second connector.
Figure 7:
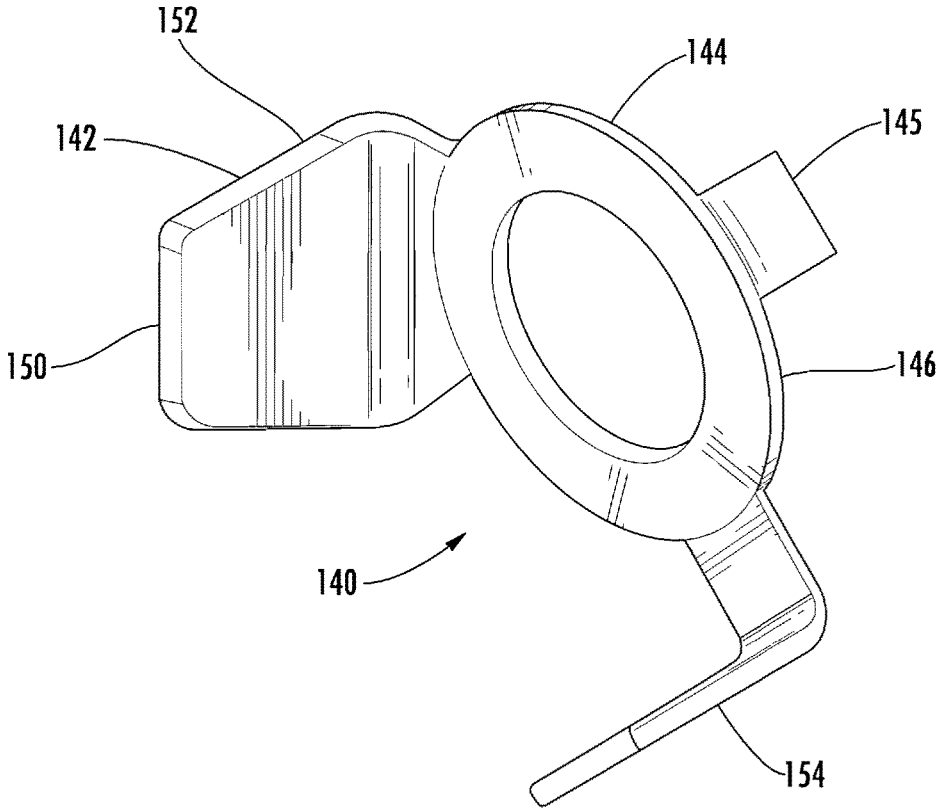
FIG. 7 is a perspective view of the third connector.
Figure 8:
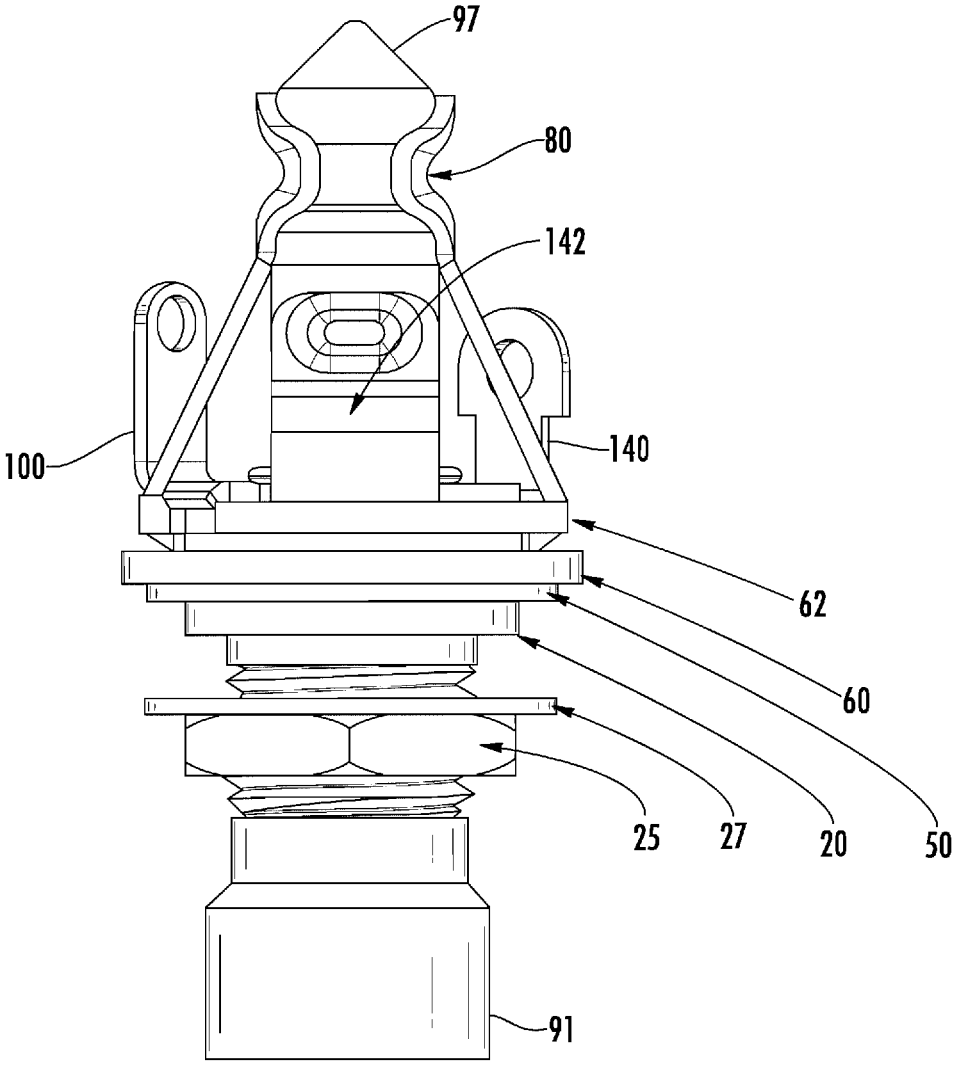
FIG. 8 is a side view of the stereo audio jack assembly with a plug inserted.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Now referring to the drawings, set forth is a stereo audio jack assembly 10 for receiving a conventional audio plug. The preferred audio plug is a conventional 6.35 mm (¼ inch) plug that has been an industry standard for over a century. The audio plug includes a groove formed along a tip, which operates as a detent and is commonly used for securing the audio plug into a receiving jack assembly.

The instant invention is directed to an improved stereo audio jack assembly 10, which consists of a support housing 20 having an entry collar 22 which is circular in shape and may include threads 24 for securement to a façade, not shown, commonly found on audio equipment. The threads 24 are used to engage a securement nut 25 placed on the access side of a support frame, not shown. A washer 27 can be used between the support housing 20 and the securement nut 25. A support surface 26 having an upper surface 28 adjoins the entry collar 22. The upper surface 28 may include a friction induced surface that aids in mounting of the assembly to prevent spinning of the support housing while being threaded. The support surface 26 has a diameter that is larger than the diameter of the entry collar 22 for an adjoining mounting collar 30. In this manner, the support housing 20 having the upper surface 28 is used for engaging the remainder of the jack assembly, and the lower surface 32 is used for engaging the access side of the support frame. The support housing 20 has a passageway 34 extending through the mounting collar 30, the support surface 26, and the entry collar 22 to allow passage of the tip of an audio plug.

A first insulating ring 50 is positionable over the mounting collar 30, having a central aperture 52 sized for placement over the mounting collar and an outer edge 54 of a diameter so as to engage surface 28. The insulating rings used herein are preferably constructed from a non-conductive material such as plastic, fiber, rubber, cord, paper or the like.

The first insulating ring 50 supports the first connector 60 having a disk base 62 with a centrally disposed aperture 64, formed integral with a first terminal strip 66 and a second terminal strip 68. Each of the terminal strips 66, 68 extend obliquely and symmetrically from an outer edge of the first disk base 62. The first terminal strip 66 has a proximal end 72 extending from first disk base 62 to a distal end 74; the second terminal strip 68 has a proximal end 76 extending to a distal end 78, forming a mirror image of the first terminal strip 66. The first and second terminal strips 66, 68 have a length from the distal end to the proximal end sized to engage the groove on an audio plug. As illustrated, the first and second terminal strips are biased inward to provide a uniform clamping against the groove of an audio plug. The distal ends 74 and 78 include scallop formations depicted as numerals 80 and 82 which are constructed and arranged to grasp a portion of the groove, creating a semi-circular attachment to the groove to provide multiple contact points with the surface of the groove. The first connector 60 includes a coupling tab 84, of which an audio wire may be secured thereto. The tab 84 provides a resistant-free connection to the first and second terminal strips 66 and 68, and positive engagement to an audio plug.

A second insulating ring 90 is made of a non-conductive material similar to the first insulating ring 50. The second insulating ring has a centrally disposed aperture 92 and an outer edge 94 having terminal strip sections 96, 98 for receipt of the proximal ends 72 and 76 of terminal strips 66, 68. The terminal strips 66, 68 maintain the second insulating ring 90 in a fixed position. The second insulating ring 90 encapsulating the base 62 to isolate the first connector 60.

A second connector 100 is formed from a base 102 having a centrally disposed aperture 104, which frictionally engages the upper portion of the mounting collar 20. The second connector 100 can be snapped onto the support housing 20. A terminal strip 106 has a proximal end 108 and a distal end 110 so as to engage a portion of the sleeve of the audio plug. Similar to the first connector, a scallop shape 112 conforms to the portion of the audio plug, providing multiple contact points that are arranged to impact a greater portion of the audio plug to eliminate resistance. The second connector 100 includes a second coupling tab 114 for securement to an electrical wire for carrying of an audio signal.

A third insulating ring 120 is made of a non-conductive material similar to the first and second insulating rings. The third insulating ring has a centrally disposed aperture 122 and an outer edge 124 having terminal strip sections 126 and 128 for receipt of the proximal ends of terminal strips 66 and 68. Section 130 positions terminal strip 106 of the second connector, and section 132 positions terminal strip 142 of the third connector. The sections maintain the second and third connectors in a fixed position.

The third connector 140 is formed from a base 144 having a centrally disposed aperture 146 that frictionally engages the upper portion 26 of the mounting collar 30. The third connector 140 can be snapped onto the support housing 20 or secured thereto with a coupling such as a snap ring. Tab 145 may also be used to engage a section of an insulating ring to prevent rotation of the connector. A terminal strip 142 has a proximal end 148 and a distal end 150 so as to engage a portion of the sleeve of the audio plug. Similar to the first and second connectors, a scallop shape 152 conforms to the portion of the audio plug, providing multiple contact points that are arranged to impact a greater portion of the audio plug to eliminate resistance. The third connector 140 includes a third coupling tab 154 for securement to an electrical wire for carrying of an audio signal.

For ease of clarification, a ¼ inch plug and audio jack assembly has been described as the primary embodiment. However, it is obvious to one skilled in the art, and to be understood, that the audio jack assembly illustrated can be scaled to received ⅛ inch plug or micro plug sizes using the same terminal configuration. The claims of this invention are not limited to the size of plug and are applicable to ¼ inch, ⅛ inch, or micro plugs.

A conventional stereo plug 91 has a shank 93 which operates as a ground, a first stereo input section 95 and a second stereo input section 97. Isolation rings 99 and 101 provide spacing between the input sections and the ground. The addition of a grounding contact eliminates the unreliable pressure ground of a conventional jack plug that when pressure is provide by pushing the shank against the wall of the fack body.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art, which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims. The term "coupled" is defined as connected, although not necessarily directly, and not necessarily mechanically.

What is claimed is:

1. A stereo audio jack assembly for receiving a conventional audio plug comprising:

a support housing having a passageway sized to receive the audio plug, said support housing having an entry collar, a support surface adjoining said entry collar, and a mounting collar adjoining said support surface;

a first insulating ring positionable on said mounting collar;

a first connector having a first disk base with a centrally disposed aperture, said first disk base supporting first and second terminal strips each having a proximal end formed integral with said first disk base and extending obliquely and symmetrically from an outer edge of said first disk base to a distal end each positioned to engage a grooved tip of the audio plug when engaged, said first connector positionable on said mounting collar having a coupling tab 84 formed integral to said first and second terminal strips, said first connector electrically isolated from said support surface by said first insulating ring;

a second insulating ring positionable on said mounting collar;

a second connector having a second disk base with a centrally disposed aperture and a third terminal strip (106) having a proximal end extending from an outer edge of said second disk base to engage a portion of said audio plug when inserted, said second connector positionable on said mounting collar having a second coupling tab formed integral to said third terminal strip, said second connector electrically isolated from said first connector by said second insulating ring;

a third insulating ring positionable on said mounting collar;

a third connector having a third disk base with a centrally disposed aperture and a fourth terminal strip having a proximal end extending obliquely and symmetrically from an outer edge of said third disk base to a distal end positioned to engage a portion of the audio plug, said third connector positionable on said mounting collar having a third coupling tab formed integral to said third connector, said third connector electrically isolated from said second connector by said third insulating ring;

wherein said connectors are fastened to said support housing.

2. The audio plug assembly according to claim 1 wherein said entry collar has a first diameter, said support surface has a second diameter, and said mounting collar has a third diameter, said second diameter greater than said first diameter.

3. The audio plug assembly according to claim 1 wherein each said insulating ring includes a centrally disposed opening sized to fit over said mounting collar.

4. The audio plug assembly according to claim 1 wherein said second insulating ring includes alignment notches for maintaining said second third terminal strip in a predetermined axial alignment with said first and second terminal strips.

5. The audio plug assembly according to claim 1 wherein said third insulating ring includes alignment notches for maintaining said fourth terminal strip in a predetermined axial alignment with said first and second terminal strips.

6. The audio plug assembly according to claim 1 wherein said distal ends of each said connector include a scallop shape constructed and arranged to engage a section of the sleeve of an audio plug.

7. The audio plug assembly according to claim 1 wherein said distal ends of each said second connector terminal strip include said scallop shape constructed and arranged to engage a section of the groove of an audio plug.

8. The audio plug assembly according to claim 1 wherein said mounting collar is threaded.

* * * * *